US008811647B2

(12) United States Patent
Hansson et al.

(10) Patent No.: US 8,811,647 B2
(45) Date of Patent: Aug. 19, 2014

(54) AUDIO JACK CONFIGURATOR FOR A PORTABLE ELECTRONIC DEVICE

(75) Inventors: Magnus Hansson, Waterloo (CA); Mohamad El-Hage, Kitchener (CA)

(73) Assignee: BlackBerry Limited, Waterloo, Ontario (CA)

( * ) Notice: Subject to any disclaimer, the term of this patent is extended or adjusted under 35 U.S.C. 154(b) by 363 days.

(21) Appl. No.: 13/372,033

(22) Filed: Feb. 13, 2012

(65) Prior Publication Data

US 2012/0144072 A1 Jun. 7, 2012

Related U.S. Application Data

(63) Continuation of application No. 12/393,681, filed on Feb. 26, 2009, now Pat. No. 8,150,046.

(51) Int. Cl.
*H04R 25/00* (2006.01)

(52) U.S. Cl.
USPC ..... 381/384; 381/379

(58) Field of Classification Search
USPC ..... 381/379, 384; 439/164, 584, 660, 668
See application file for complete search history.

(56) References Cited

U.S. PATENT DOCUMENTS

| | | | |
|---|---|---|---|
| 6,069,960 | A | 5/2000 | Mizukami |
| 6,594,366 | B1 | 7/2003 | Adams |
| 2005/0055731 | A1 | 3/2005 | Burnett |
| 2005/0201568 | A1 | 9/2005 | Goyal |
| 2007/0047745 | A1 | 3/2007 | Lai et al. |
| 2007/0104332 | A1 | 5/2007 | Clemens et al. |
| 2007/0255435 | A1 | 11/2007 | Cohen et al. |
| 2008/0137896 | A1 | 6/2008 | Tsen |
| 2008/0146292 | A1 | 6/2008 | Gilmore et al. |

FOREIGN PATENT DOCUMENTS

GB 2387979 A 10/2003

*Primary Examiner* — Brian Ensey
(74) *Attorney, Agent, or Firm* — McCarthy Tétrault LLP

(57) ABSTRACT

A portable electronic device having an audio jack is provided. The device comprises: a processor provided in a housing; a display screen; a jack provided in the housing, the jack being sized for receiving a plug of an audio accessory of the plurality of audio accessories; electrical connectors provided in the jack for enabling communication between the audio accessory and the processor, each of the electrical connectors for contacting a corresponding electrical connector of the plug; and a switching circuit in communication with the processor and two of the electrical connectors. For the device, upon detection of insertion of the plug into the jack, the processor is adapted to generate a prompt on the display screen to allow selection of a pin-out configuration for the audio accessory from different pin-out options for the audio accessory. A method of configuring audio jacks for an electronic device is also provided.

15 Claims, 9 Drawing Sheets

AUDIO JACK CONFIGURATOR FOR A PORTABLE ELECTRONIC DEVICE

RELATED APPLICATION

The present application is a continuation application of U.S. patent application Ser. No. 12/393,681 filed on Feb. 26, 2009 now U.S. Pat. No. 8,150,146.

TECHNICAL FIELD

The present disclosure relates to audio jack configurators for portable electronic devices.

BACKGROUND

In recent years, the accessibility and affordability of hand-held technologies has made it commonplace for a single consumer to own several different portable electronic devices. Depending on the type of portable electronic device, accessories such as battery chargers and head phones, for example, may be provided in the packaging. Whether replacing a cell phone year after year or adding a portable music player, digital video camera or portable video game player to one's collection, duplication of accessories is very common.

Currently, there are no industry standards in place that dictate audio jack pin-out configuration for electronic devices having audio input and output capability. Therefore, the same headset, for example, will generally not work with portable electronic devices from different manufacturers. In order to avoid this problem, some electronic device vendors have begun to dictate the audio jack pin-out of the portable electronic devices that it will sell in order to ensure that the same accessories will work with the different devices. It is common for vendors in different countries to have different pin-out preferences, therefore, portable electronic device manufacturers who sell their devices to more than one vendor must incur additional costs to produce devices having different audio jack pin-outs.

One solution to this problem is to sell adapters that enable communication between incompatible accessories and portable electronic devices. This solution results in additional costs to the manufacturer and the consumer and also has the added inconvenience of requiring the consumer to keep track of adapters specific to each accessory. It may be, therefore, desirable to provide an improved solution to the incompatibility of portable electronic devices and accessories.

DRAWINGS

The following figures set forth embodiments in which like reference numerals denote like parts. Embodiments are illustrated by way of example and not by way of limitation in the accompanying figures.

DETAILED DESCRIPTION OF EMBODIMENTS

Figure 1:
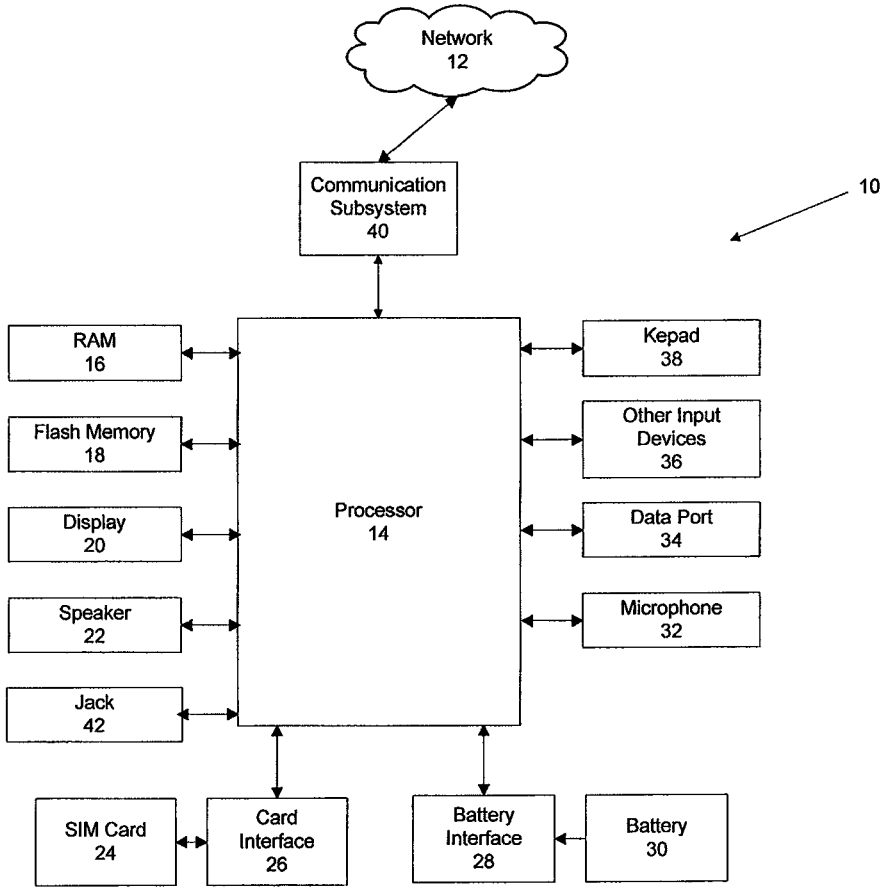
FIG. 1 is a block diagram of a portable electronic device according to an embodiment.

In a first aspect, a portable electronic device having a connection for a plurality of audio accessories is provided. The device comprises: a processor provided in a housing; a display screen; a jack provided in the housing, the jack being sized for receiving a plug of an audio accessory of the plurality of audio accessories; electrical connectors provided in the jack for enabling communication between the audio accessory and the processor, each of the electrical connectors for contacting a corresponding electrical connector of the plug; and a switching circuit in communication with the processor and two of the electrical connectors, the switching circuit for selectively routing audio signals between the corresponding electrical connectors of the plug and the processor. For the device, upon detection of insertion of the plug into the jack, the processor is adapted to generate a prompt on the display screen to allow selection of a pin-out configuration for the audio accessory from different pin-out options for the audio accessory.

For the device, the prompt may provide a selection of types of audio accessories from a drop-down list.

For the device, the selection may includes at least one of a list of pin-outs, product manufacturers, product serial numbers and a list of countries corresponding to where the audio accessories in the list were manufactured.

For the device, the switching circuit may be configured to route audio signals between the corresponding electrical connectors of the plug and the processor according to the pin-out configuration selected from the different pin-out options.

For the device, the plurality of audio accessories may comprise any of: a microphone, stereo headsets, stereo headphones, mono headsets and mono headphones.

For the device, the first one of the corresponding electrical connectors and the second one of the corresponding electrical connectors may be located adjacent to one another at a base of the plug.

For the device, the switching circuit may comprise a switch having a first position and a second position, the audio signals being routed between the first one of the corresponding electrical connectors of the plug and the processor when the switch is in the first position.

For the device, the plug may be one of a 2.5 mm plug and a 3.5 mm plug.

In a second aspect, a method for connecting of an audio accessory of a plurality of audio accessories to a portable electronic device is provided. The method comprises: receiving a plug of the audio accessory in a jack of the portable electronic device, the jack having electrical connectors for enabling communication between the audio accessory and a processor of the portable electronic device, each of the electrical connectors for contacting a corresponding electrical connector of the plug; and upon detection of insertion of the plug into the jack, generating a prompt on a display screen of the electronic device to allow selection of a pin-out configuration for the audio accessory from different pin-out options for the audio accessory.

For the method, the prompt may provide a selection of types of audio accessories from a drop-down list.

For the method, the selection may include at least one of a list of pin-outs, product manufacturers, product serial numbers and a list of countries corresponding to where the audio accessories in the list were manufactured.

The method may further comprise routing audio signals between the corresponding electrical connectors of the plug and the processor according to the pin-out configuration selected from the different pin-out options.

For the method, the first one of the corresponding electrical connectors and the second one of the corresponding electrical connectors may be located adjacent to one another at a base of the plug.

For the device, the audio accessory may be any of: a microphone, stereo headsets, stereo headphones, mono headsets and mono headphones.

For the method, the first one of the corresponding electrical connectors and the second one of the corresponding electrical connectors may be located adjacent to one another at a base of the plug.

In another aspect of an embodiment, a portable electronic device is provided. The device comprises: a processor provided in a housing; a jack provided in the housing, the jack being sized for receiving a plug of an audio accessory; electrical connectors provided in the jack for enabling communication between the audio accessory and the processor, each of the electrical connectors for contacting a corresponding electrical connector of the plug; and a switching circuit in communication with the processor and two of the electrical connectors, the switching circuit for selectively routing audio signals between a second one of the corresponding electrical connectors of the plug and the processor. In the device, the switching circuit routes the audio signals between a second one of the corresponding electrical connectors of the plug and the processor when a first one of the corresponding electrical connectors of the plug is electrically grounded. The audio signals being routed may be signals from a microphone.

In the device, no audio signals may be routed to the processor when both the first one of the corresponding electrical connectors of the plug and the second one of the corresponding electrical connectors of the plug are electrically grounded.

In the device, the audio accessory may be selected from the group consisting of: stereo headsets, stereo headphones, mono headsets and mono headphones.

In the device, the first one of the corresponding electrical connectors and the second one of the corresponding electrical connectors may be located adjacent to one another at a base of the plug.

In the device, the switching circuit may include a switch having a default position and a second position, the audio signals being routed between the first one of the corresponding electrical connectors of the plug and the processor when the switch is in the default position.

In the device, the switch may be changed from the default position to the second position based on an outcome of an impedance test.

In yet another aspect of an embodiment, a method for connecting a plug of an audio accessory to a portable electronic device is provided. The method comprises: receiving a plug of the audio accessory in a jack of the portable electronic device, the jack having electrical connectors for enabling communication between the audio accessory and a processor of the portable electronic device, each of the electrical connectors for contacting a corresponding electrical connector of the plug; determining if a first one of the corresponding electrical connectors of the plug is electrically grounded; and routing audio signals between a second one of the corresponding electrical connectors of the plug and the processor when the first one of the corresponding electrical connectors of the plug is electrically grounded. The audio signals being routed may be signals from a microphone.

In the method, no audio signals may be routed to the processor when both the first one of the corresponding electrical connectors of the plug and the second one of the corresponding electrical connectors of the plug are electrically grounded.

In the method, the audio accessory may be selected from the group consisting of: stereo headsets, stereo headphones, mono headsets and mono headphones.

In the method, the switching circuit may include a switch having a default position and a second position, the audio signals being routed between the first one of the corresponding electrical connectors of the plug and the processor when the switch is in the default position.

The method may further comprise performing a test to determine if the first one of the corresponding electrical connectors in contact with the first one of the electrical connectors of the jack is electrically grounded.

In the method, the test may be an impedance test.

In the method, the impedance test may include applying a voltage to a microphone bias connector, reading a voltage at a microphone detection connector and comparing the voltage reading to a predetermined threshold value.

In the method, the test may be performed in response to the switching circuit detecting that the audio accessory is received in the jack.

In another embodiment, there is provided a portable electronic device including: a processor provided in a housing, a jack provided in the housing, the jack being sized for receiving a plug of an audio accessory, electrical connectors provided in the jack for enabling communication between the audio accessory and the processor, the electrical connectors for contacting corresponding electrical connectors of the plug and a switching circuit in communication with the processor and the electrical connectors, the switching circuit for determining a pin-out of the plug; wherein the switching circuit routes signals between ungrounded ones of the corresponding electrical connectors of the plug and the processor.

In yet another embodiment, there is provided a method for connecting a plug of an audio accessory to a portable electronic device, the method including: receiving a plug of the audio accessory in a jack of the portable electronic device, the jack having electrical connectors for enabling communication between the audio accessory and a processor of the portable electronic device, the electrical connectors for contacting corresponding electrical connectors of the plug, determining a pin-out of the plug and routing signals between ungrounded ones of the corresponding electrical connectors of the plug and the processor.

The embodiments provided herein allow audio accessories having pin-outs that do not match a pin-out of the portable electronic device to be operated therewith. The inclusion of a switching circuit in the portable electronic device may reduce or eliminate the need for separate adapter components.

Referring now to FIG. 1, components of a portable electronic device 10 according to an embodiment are generally shown. The portable electronic device 10 includes data communication capabilities and may communicate with other electronic devices directly or through a wireless network. The portable electronic device 10 is based on the computing environment and functionality of a handheld computer, such as a wireless personal digital assistant (PDA), for example. It will be understood, however, that the portable electronic device 10 is not limited to a wireless personal digital assistant. Other portable electronic devices are possible, such as cellular telephones, smart telephones, portable music players and laptop computers.

The portable electronic device 10 includes a number of components including processor 14, which controls the overall operation of the device 10. A communication subsystem 40 controls data and voice communication functions, such as email, PIN (Personal Identification Number) message functions, SMS (Short Message Service) message functions and cellular telephone functions, for example. The communication subsystem 40 is in communication with a wireless network 12, which may be a data-centric wireless network, a voice-centric wireless network or a dual-mode wireless network.

In FIG. 1, the communication subsystem 40 is a dual-mode wireless network that supports both voice and data communications. The communication subsystem 40 is configured in accordance with the Global System for Mobile Communication (GSM) and General Packet Radio Services (GPRS) standards. The communication subsystem 40 may alternatively be configured in accordance with Enhanced Data GSM Environment (EDGE) or Universal Mobile Telecommunications Service (UMTS) standards. Other wireless networks may also be associated with the portable electronic device 10, including Code Division Multiple Access (CDMA) or CDMA2000 networks. Some other examples of data-centric networks include WiFi 802.11, Mobitex™ and DataTAC™ network communication systems. Examples of other voice-centric data networks include Personal Communication Systems (PCS) networks like GSM and Time Division Multiple Access (TDMA) systems.

The wireless network 12 includes base stations (not shown) that provide a wireless link to the portable electronic device 10. Each base station defines a coverage area, or cell, within which communications between the base station and the portable electronic device 10 can be effected. It will be appreciated that the portable electronic device 10 is movable within the cell and can be moved to coverage areas defined by other cells. Data is delivered to the portable electronic device 10 via wireless transmission from base station. Similarly, data is sent from the portable electronic device 10 via wireless transmission to the base station.

The communication subsystem 40 further includes a short range communications function, which enables the device 10 to communicate directly with other devices and computer systems without the use of the network 106 through infrared or Bluetooth technology, for example.

Prior to the portable electronic device 10 being able to send and receive communication signals over the wireless network 12, network registration or activation procedures must have been completed. In order to enable network communication, a SIM (Subscriber Identity Module) card 24 is inserted into a card interface 26. The SIM card, or Removable User Identity Module card, is used to identify the user of the mobile device, store personal device settings and enable access to network services, such as email and voice mail, for example, and is not bound to a particular portable electronic device 10.

The processor 14 is also connected to a Random Access Memory (RAM) 16 and a flash memory 18. An operating system and device software are typically stored in flash memory 18 and are executable by the processor 14. Some device software components may alternatively be stored in RAM 16. Software applications that control basic device operation, such as voice and data communication, are typically installed during manufacture of the device 10. For devices that do not include a SIM card 24, user identification information may be programmed into the flash memory 18. The flash memory 18 may alternatively be a persistent storage, a Read-Only Memory (ROM) or other non-volatile storage.

The processor 14 receives input from various input devices including a keypad 38 and other input devices 36. The other input devices 36 typically complement the keypad 38 to facilitate input and may include devices such as: single or multi-function buttons, a touch screen, a mouse, a trackball, a capacitive touch sensor or a roller wheel with dynamic button pressing capability.

The processor 14 outputs to various output devices including an LCD display screen 20. A microphone 32 and speaker 22 are connected to the processor 14 for cellular telephone functions. A data port 34 is connected to the processor 14 for enabling data communication between the portable electronic device 10 and another computing device. The data port 34 may include data lines for data transfer and a supply line for charging a battery 30 of the portable device 10. Battery interface 28 is provided for receiving one or more rechargeable batteries 30. Jack 42 is provided for receiving an audio accessory such as headphones, a headset, amplified speakers or amplified headphones, for example. Jack 42 may also receive other accessories such as a multi-media accessory including play, pause, stop and rewind buttons or a TV-out accessory that allows for connection of the portable electronic device to a TV, for example.

Only a limited number of device subsystems have been described. It will be appreciated by a person skilled in the art that additional subsystems corresponding to additional device features may also be connected to the processor 14.

Figure 2:
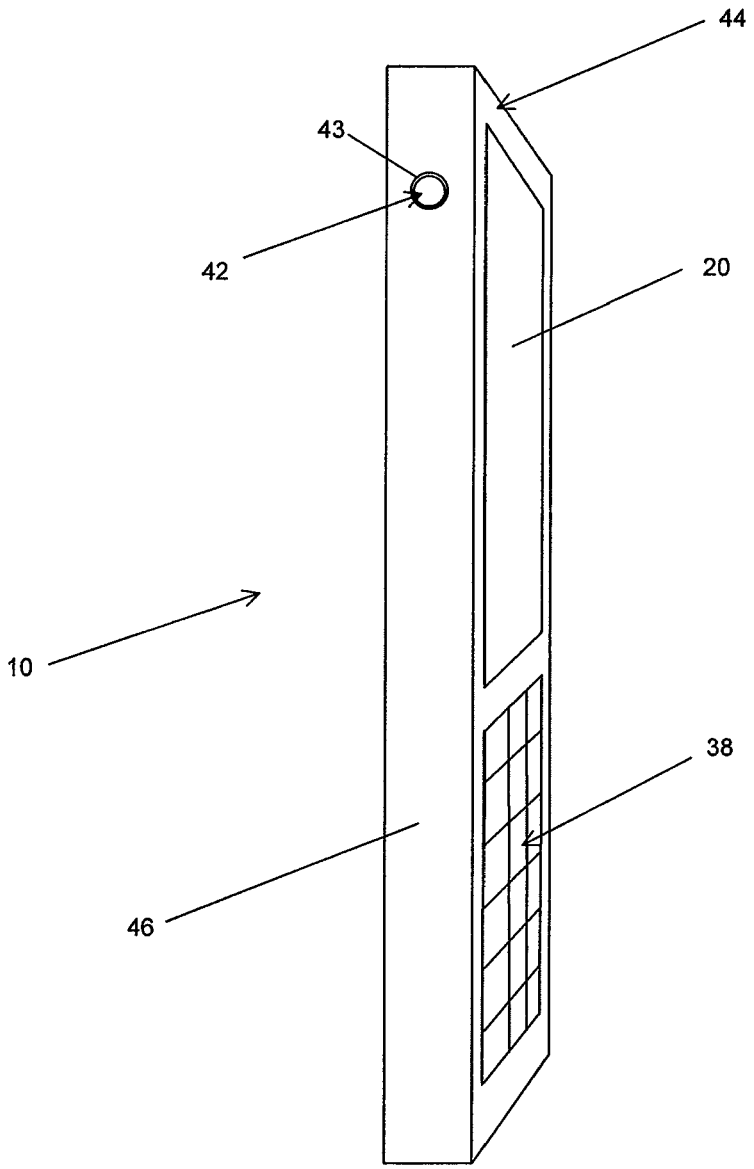
FIG. 2 is a perspective view of the portable electronic device of FIG. 1.

Referring also to FIG. 2, the portable electronic device 10 includes a housing 44 in which the display 20 and keypad 38 are mounted. The jack 42 is provided in an opening 43 in a side surface 46 of the housing 44. It will be appreciated by a person skilled in the art that the arrangement of FIG. 2 is provided by way of example. The display 20, the keypad 38, the jack 42 and also other input devices 36 may be provided in any arrangement that allows the user to interact with the portable electronic device 10.

Figure 3:
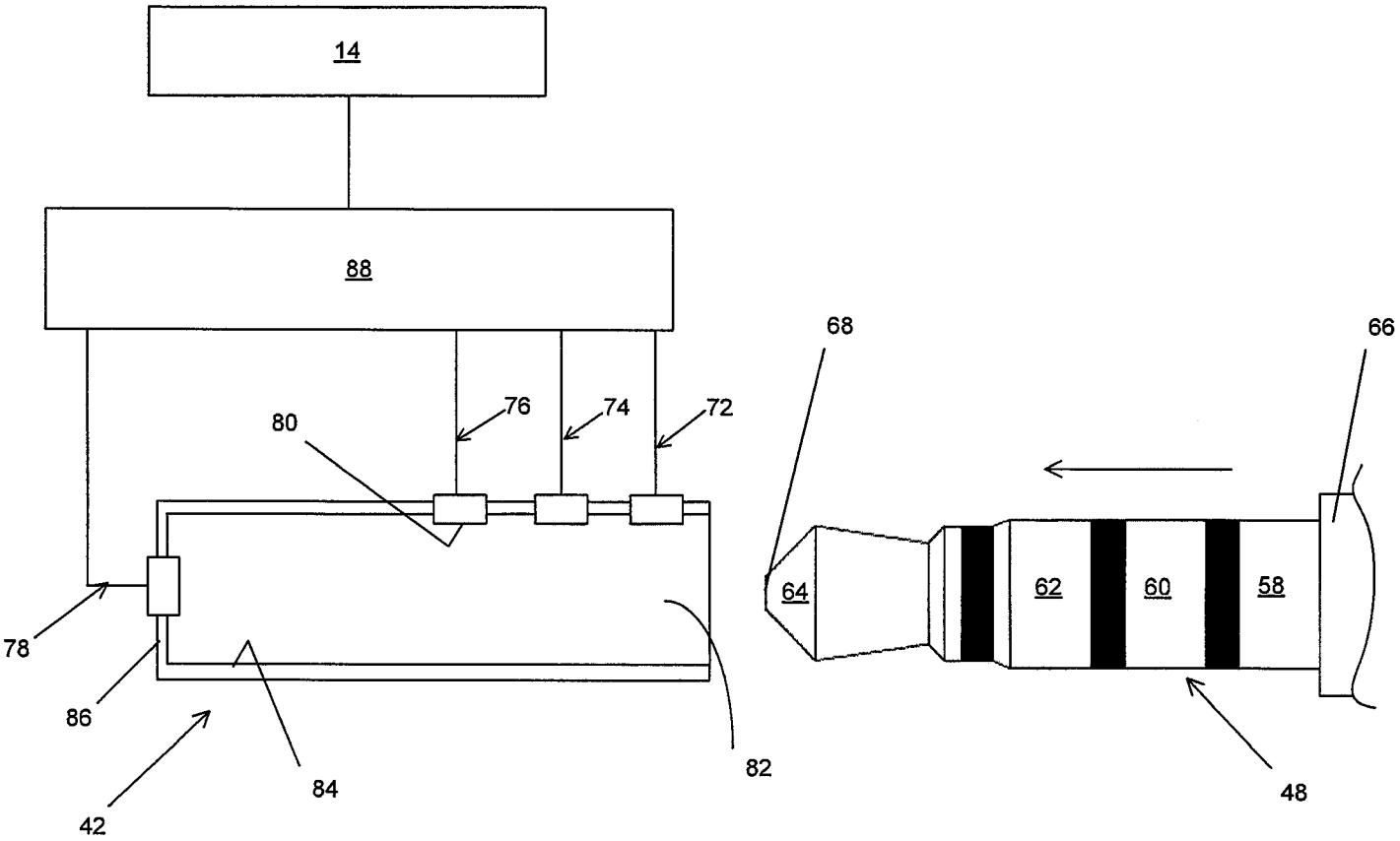
FIG. 3 is a schematic side view of an audio jack of the portable electronic device of FIG. 1 in section and a side view of a plug of an audio accessory for use with the audio jack.

As shown in FIG. 3, the jack 42 includes a sleeve 70 having a closed end 86 and four electrical connectors 72, 74, 76 and 78. A plug-receiving cavity 82 of the jack 42 is generally defined by an inner surface 84 of the sleeve 70 and is sized to receive a plug 48 of a headset (not shown). The electrical connectors 72, 74, 76, 78 each include a conductive surface 80 that extends into the plug-receiving cavity 82. When the plug 48 of the headset is received in the jack 42, the conductive elements 80 of the electrical connectors 72, 74, 76, 78 mate with corresponding conductive surfaces of electrical connectors 58, 60, 62 and 64 of the plug 48, respectively, to provide an electrical path between headset components, which include a microphone, a left speaker and a right speaker, and matching ports of the processor 14.

It will be appreciated by a person skilled in the art that rather than including the sleeve 70, the plug-receiving cavity 82 may be defined by the housing 44 or one or more other components of the portable electronic device 10.

Electrical connectors 58, 60, 62 and 64 are provided in order between a base 66 and a tip 68 of the plug 48. Therefore, when the plug 48 is received in the jack 42, electrical connector 72 of the jack 42 mates with electrical connector 58 of the plug 48, electrical connector 74 of the jack 42 mates with electrical connector 60 of the plug 48, electrical connector 76 of the jack 42 mates with electrical connector 62 of the plug 48 and electrical connector 78 of the jack 42 mates with electrical connector 64 of the plug 48.

In order for the left speaker, the right speaker, the microphone and a ground of the headset to operate as expected, a pin-out of the plug 48 and a pin-out of the jack 42 should match. The term pin-out is well known in the art and describes the purpose of each connector, which is commonly referred to as a pin, in a connecting device, such as a jack or a plug, for example. The pin-out of the jack 42 of the portable electronic device 10 of FIG. 1 is as follows:

| | |
|---|---|
| Electrical connector 72 | Microphone |
| Electrical connector 74 | Ground |
| Electrical connector 76 | Right Audio channel |
| Electrical connector 78 | Left Audio Channel |

Figure 4:
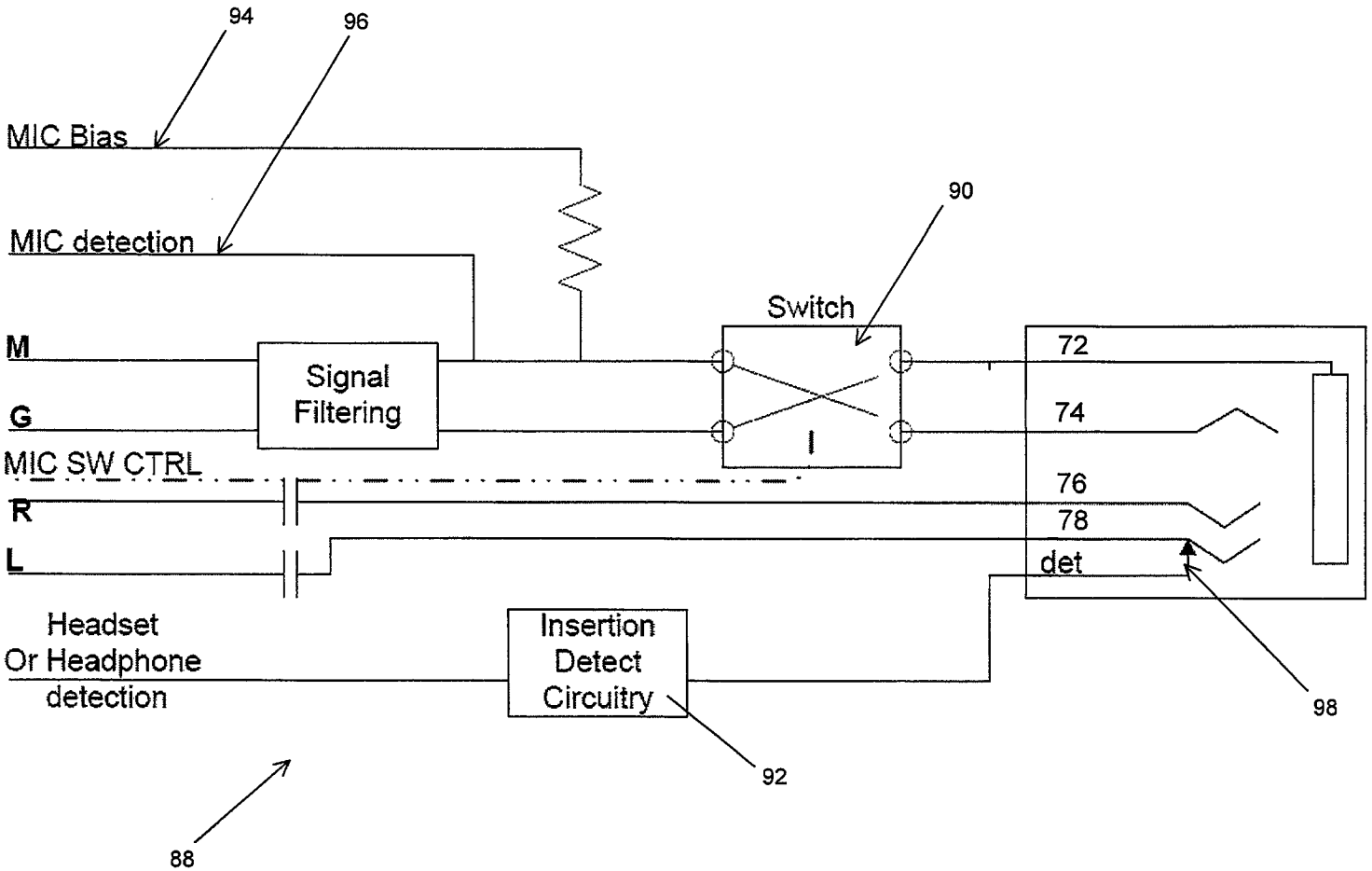
FIG. 4 is a circuit diagram of a switching circuit of the portable electronic device of FIG. 1.

As shown in FIG. 3, the electrical connectors 72, 74, 76, 78 are electrically coupled to the processor 14 via a switching circuit 88, which is shown in FIG. 4. In general, the switching circuit 88 is provided to determine the pin-out of the plug 48 and swap microphone and ground signals when the pin-out of the plug 48 does not match the pin-out of the jack 42. Specifically, the switching circuit 88 determines if electrical connector 58 is electrically grounded and, if so, routes audio signals from electrical connector 60 of the plug 48, if ungrounded, through electrical connector 72 of the jack 42 to the processor 14. The switching circuit 88 uses impedance testing to determine the pin-out of the plug 48.

Voltages are measured with respect to some sort of reference voltage, which is called the ground. In some cases, the voltage of the Earth itself serves as the reference, or ground. On a portable electronic device that is not electrically connected by a wire to the Earth, one electrical node is selected to be the "ground node," and it is with reference to the voltage of this node that other voltages are measured. To say that a connector is "electrically grounded" can be to mean that the connector is electrically coupled to, or is at substantially the same electric potential as, that ground node. As a practical matter, the voltage of a grounded connector has substantially zero difference in voltage with the ground node, and so would be measured as having a substantially constant voltage of about zero volts. Since typical electrical signals involve voltage changes, a connector that is electrically grounded typically is carrying no signal.

Figure 5:
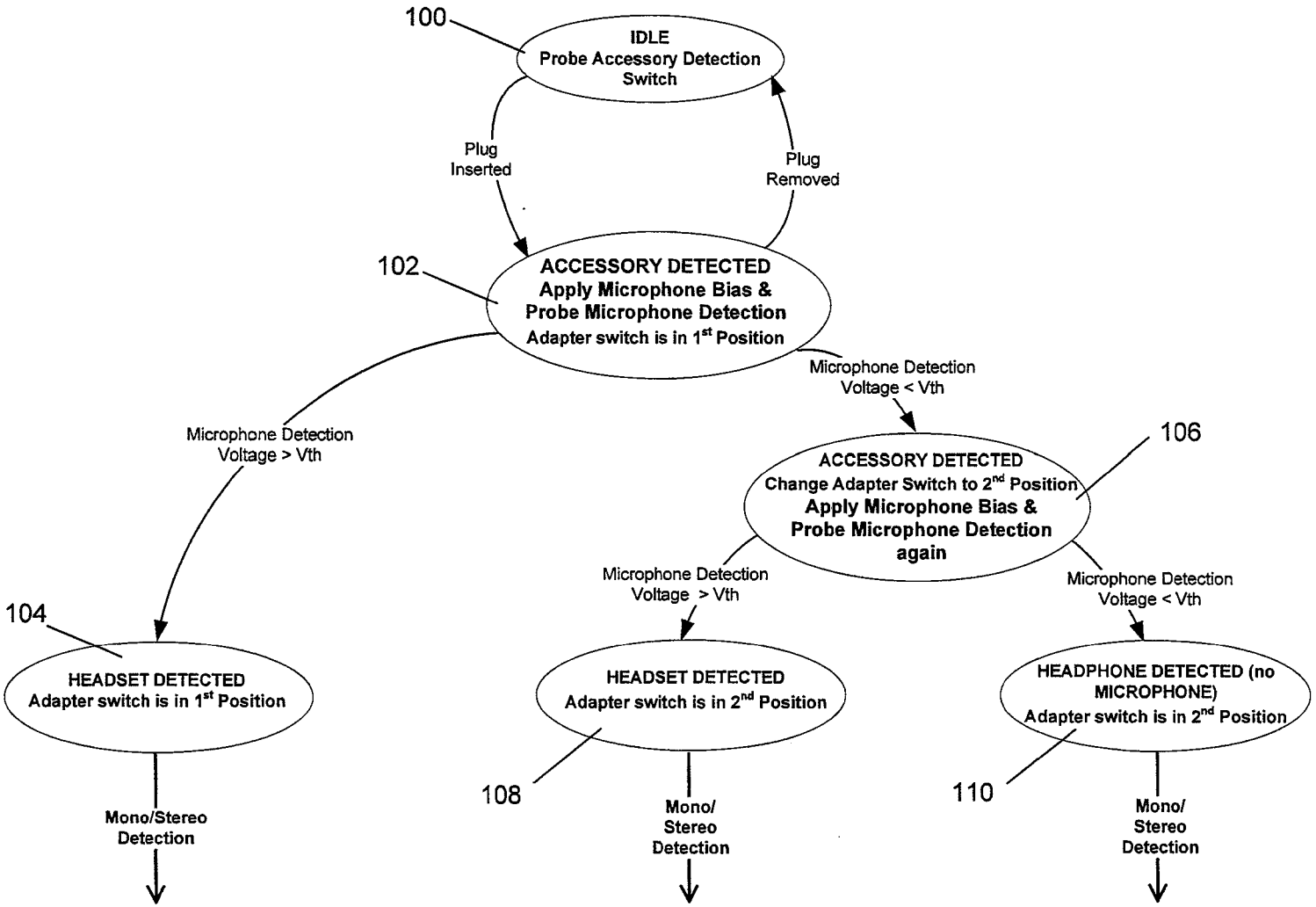
FIG. 5 is a state diagram corresponding to the circuit diagram of FIG. 4.

Referring to FIGS. 4 and 5, the switching circuit 88 includes a normally closed switch 98 between electrical connector 78 of the jack 42, which corresponds to the left audio channel, and an accessory detection circuitry 92. At state 100, the switching circuit 88 is in an idle mode when no plug 48 is received in the jack 42. When a plug 48 is received in the jack 42, the normally closed switch 98 opens and a signal interrupt is sent to the processor 14 to notify the processor 14 that an audio accessory has been inserted into the jack 42. When the audio accessory is detected, at state 102, the processor 14 performs a test to determine if the electrical connector 58 of the plug 48 is electrically grounded. The test is an impedance test that the processor 14 performs by: 1) applying a voltage to a microphone bias connector 94 to bias the electrical connector 72; 2) reading a direct current (DC) voltage at a microphone detection connector 96; and 3) comparing the DC voltage reading to a predetermined threshold value, Vth. At state 102, a switch 90 of the switching circuit is in a first position, which is the default position, to route audio signals from electrical connectors 58 and 60 of the plug 48 to mating electrical connectors 72 and 74 of the jack 42. A DC voltage reading that is high indicates that the electrical connector 58 is not electrically grounded. Therefore, it follows that the electrical connector 58 is connected to a microphone and the audio accessory is a headset, as indicated at state 104.

Figure 6:
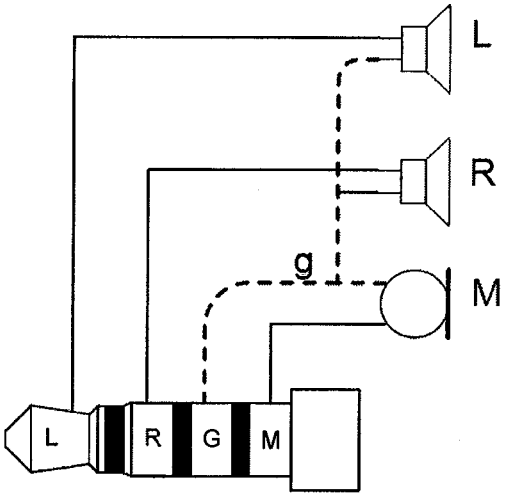
FIG. 6 is a schematic side view of a plug and headset for use with the portable electronic device of FIG. 1.
Figure 7:
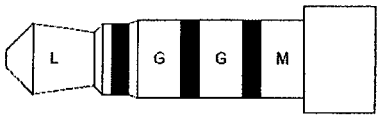
FIG. 7 is a side view of a plug for use with the portable electronic device of FIG. 1.

A four pole stereo headset plug is shown in FIG. 6 and a four pole mono headset plug is shown in FIG. 7. When headset plugs of FIGS. 6 and 7 are inserted into the jack 42, the switching circuit 88 determines that the electrical connector 58 is not electrically grounded and the processor 14 operates the audio accessory with the adapter switch 90 in the first position.

A DC voltage reading from the impedance test that is low indicates that the electrical connector 58 is electrically grounded, and therefore, the accessory is either a headset or headphones. In response to the outcome of the test, at state 106, the switch 90 is changed to a second position in which the electrical connector 72 of the jack 42 is in communication with the electrical connector 60 of the plug 48. The processor 14 then performs a second test in order to determine if the electrical connector 60 of the plug 48 is electrically grounded. If the DC voltage reading of the second test is high, the electrical connector 60 is not electrically grounded. Therefore, it follows that the electrical connector 60 is connected to a microphone and the audio accessory is a headset, as indicated at state 108.

Figure 8:
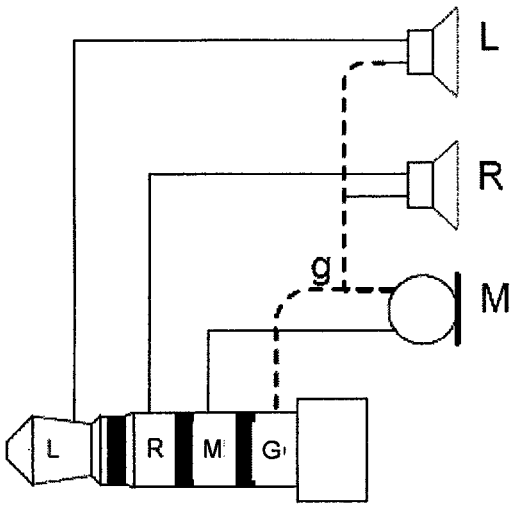
FIG. 8 is a schematic side view of a plug and headset for use with the portable electronic device of FIG. 1.

A stereo headset plug having the microphone and ground connectors reversed, when compared to the jack 42, is shown in FIG. 8. This pin-out configuration is often found in headphones and headsets that are manufactured in China. When the headset plug of FIG. 8 is inserted into the jack 42, the switching circuit 88 allows the processor 14 to operate the audio accessory with the switch 90 in the second position.

Figure 9:
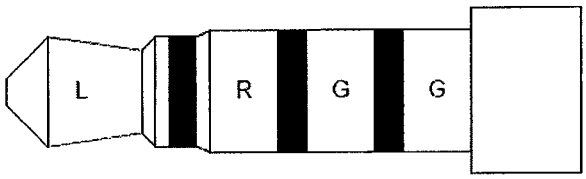
FIG. 9 is a side view of a plug for use with the portable electronic device of FIG. 1.
Figure 10:
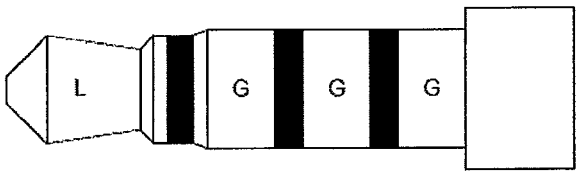
FIG. 10 is a side view of a plug for use with the portable electronic device of FIG. 1.

A DC voltage reading from the second test that is low indicates that the electrical connector 60 is electrically grounded, and therefore, the accessory is a set of headphones, as indicated at state 110. Plugs for stereo headphones and mono headphones are shown in FIGS. 9 and 10, respectively.

Once the pin-out of two of the electrical connectors of the plug 48 has been determined, a further detection scheme may be performed in order to determine the entire pin-out of the plug 48, as indicated in FIG. 5. Detection schemes for determining whether a headset or headphones is mono or stereo are known in the art and therefore will not be described further.

Figure 11:
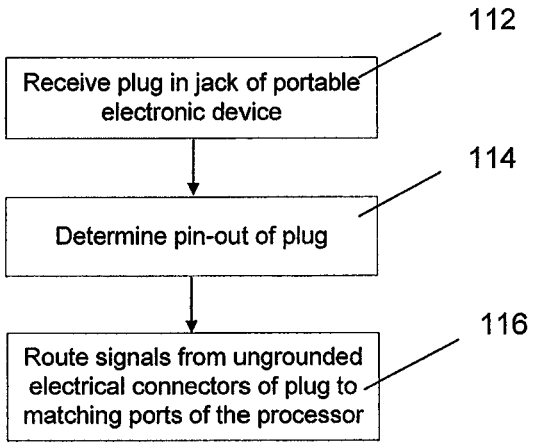
FIG. 11 is a flowchart depicting a method for connecting a plug of an audio accessory to the portable electronic device of FIG. 1 according to an embodiment.

Referring to FIG. 11, a method for connecting the plug 48 of an audio accessory to a portable electronic device is generally shown. At step 112, the plug 48 is received in the jack 42 of the portable electronic device. The pin-out of the plug 48 is then determined at step 114, as has been previously described, and audio signals from electrically ungrounded electrical connectors of the plug 48 are routed to matching ports of the processor 14 at step 116.

Figure 12:
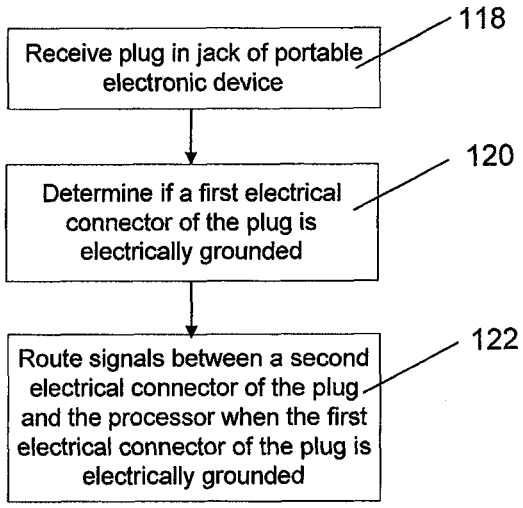
FIG. 12 is a flowchart depicting a method for connecting a plug of an audio accessory to the portable electronic device of FIG. 1 according to another embodiment.

Referring to FIG. 12, another method for connecting a plug of an audio accessory to a portable electronic device is generally shown. At step 118, the plug 48 is received in the jack 42 of the portable electronic device. At steps 120 and 122, it is determined if a first electrical connector of the plug 48 is electrically grounded and, if so, audio signals are routed between a second electrical connector of the plug 48 and the processor 14.

The jack 42 shown in FIG. 3 is sized to receive a 3.5 mm plug, however, it will be appreciated by a person skilled in the art that the jack 42 may alternatively be sized to receive a 2.5 mm plug or another size of plug.

In another embodiment, the jack 42 includes a pin-out of:

| | |
|---|---|
| Electrical connector 72 | Ground |
| Electrical connector 74 | Microphone |
| Electrical connector 76 | Right Audio channel |
| Electrical connector 78 | Left Audio Channel |

In this embodiment, the switching circuit 88 is modified to first test if electrical connector 60 of the plug 48 is electrically grounded and, if not, change switch 90 to the second position and re-test.

The switching circuit 88 of the described embodiments is suitable for use with plugs having microphone and ground electrical connectors that are located adjacent to one another at the base of the plug and in which at least one of the two connectors located adjacent to the tip of the plug are speaker electrical connectors. Plug pin-outs having this general configuration are shown in FIGS. 6-10 and are the most common pin-out configurations of headset and headphone accessories. It will, however, be appreciated by a person skilled in the art that a modified switching circuit including additional switches and further impedance testing could be provided to allow for pin-out determination of any pin-out configuration. The modified switching circuit would route audio signals between ungrounded ones of the electrical connectors of the plug and matching ports of the processor.

In another embodiment, the processor 14 executes software that is stored on the device 10 to allow a user to select different pin-out options via the keypad 38, display 20 or other input devices 36. In this embodiment, the processor 14 would not perform a test to determine the pin-out of the audio accessory. Instead, when the switching circuit 88 detects that an audio accessory has been inserted into the jack 42, the user would be prompted to select the type of audio accessory. The user would be able to select the type of audio accessory from a drop-down list, for example, which could include a list of pin-outs, product manufacturers, product serial numbers or a list of countries corresponding to where the accessory was manufactured.

Specific embodiments have been shown and described herein. However, modifications and variations may occur to those skilled in the art. All such modifications and variations are believed to be within the scope and sphere of the present embodiments.

The invention claimed is:

1. A portable electronic device having a connection for a plurality of audio accessories, comprising:

a processor provided in a housing;

a display screen;

a jack provided in the housing, the jack being sized for receiving a plug of an audio accessory of the plurality of audio accessories;

electrical connectors provided in the jack for enabling communication between the audio accessory and the processor, each of the electrical connectors for contacting a corresponding electrical connector of the plug; and a switching circuit in communication with the processor and two of the electrical connectors, the switching circuit for selectively routing audio signals between the corresponding electrical connectors of the plug and the processor, wherein:

upon detection of insertion of the plug into the jack, the processor is adapted to generate a prompt on the display screen to allow selection of a pin-out configuration for the audio accessory from different pin-out options for the audio accessory.

2. The portable electronic device as claimed in claim 1, wherein:

the prompt provides a selection of types of audio accessories from a drop-down list.

3. The portable electronic device as claimed in claim 2, wherein:

the selection includes at least one of a list of pin-outs, product manufacturers, product serial numbers and a list of countries corresponding to where the audio accessories in the list were manufactured.

4. The portable electronic device as claimed claim 1, wherein:

the switching circuit is configured to route audio signals between the corresponding electrical connectors of the plug and the processor according to the pin-out configuration selected from the different pin-out options.

5. The portable electronic device as claimed in claim 1, wherein the plurality of audio accessories comprises any of: a microphone, stereo headsets, stereo headphones, mono headsets and mono headphones.

6. The portable electronic device as claimed in claim 1, wherein the first one of the corresponding electrical connectors and the second one of the corresponding electrical connectors are located adjacent to one another at a base of the plug.

7. The portable electronic device as claimed in claim 1, wherein the switching circuit comprises a switch having a first position and a second position, the audio signals being routed between the first one of the corresponding electrical connectors of the plug and the processor when the switch is in the first position.

8. The portable electronic device as claimed in claim 1, wherein the plug is one of a 2.5 mm plug and a 3.5 mm plug.

9. A method for connecting of an audio accessory of a plurality of audio accessories to a portable electronic device, comprising:

receiving a plug of the audio accessory in a jack of the portable electronic device, the jack having electrical connectors for enabling communication between the audio accessory and a processor of the portable electronic device, each of the electrical connectors for contacting a corresponding electrical connector of the plug; and upon detection of insertion of the plug into the jack, generating a prompt on a display screen of the electronic device to allow selection of a pin-out configuration for the audio accessory from different pin-out options for the audio accessory.

10. The method as claimed in claim 9, wherein the prompt provides a selection of types of audio accessories from a drop-down list.

11. The method as claimed in claim 9, wherein:

the selection includes at least one of a list of pin-outs, product manufacturers, product serial numbers and a list of countries corresponding to where the audio accessories in the list were manufactured.

12. The method as claimed in claim 9, further comprising:

routing audio signals between the corresponding electrical connectors of the plug and the processor according to the pin-out configuration selected from the different pin-out options.

13. The method as claimed in claim 9, wherein the first one of the corresponding electrical connectors and the second one of the corresponding electrical connectors are located adjacent to one another at a base of the plug.

14. The method as claimed in claim 9, wherein the audio accessory is any of: a microphone, stereo headsets, stereo headphones, mono headsets and mono headphones.

15. The method as claimed in claim 9, wherein:

the first one of the corresponding electrical connectors and the second one of the corresponding electrical connectors are located adjacent to one another at a base of the plug.

* * * * *